US007832418B2

(12) United States Patent
Tameishi et al.

(10) Patent No.: US 7,832,418 B2
(45) Date of Patent: Nov. 16, 2010

(54) DISH WASHING MACHINE

(75) Inventors: Yoshimasa Tameishi, Aichi (JP); Tomio Suyama, Aichi (JP); Kouji Suyama, Aichi (JP); Masumi Notsu, Aichi (JP); Keiichi Toga, Aichi (JP); Tadaharu Hosogi, Aichi (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 156 days.

(21) Appl. No.: 10/589,937

(22) PCT Filed: Jan. 14, 2005

(86) PCT No.: PCT/JP2005/000391

§ 371 (c)(1),
(2), (4) Date: Apr. 16, 2008

(87) PCT Pub. No.: WO2005/077245

PCT Pub. Date: Aug. 25, 2005

(65) Prior Publication Data

US 2008/0202565 A1 Aug. 28, 2008

(30) Foreign Application Priority Data

Feb. 18, 2004 (JP) ..... 2004-041952

(51) Int. Cl.
*A47L 15/42* (2006.01)

(52) U.S. Cl. ..... 134/95.3; 134/56 D; 134/57 D; 134/58 D

(58) Field of Classification Search ..... 134/95.3, 134/56 D, 57 D, 58 D
See application file for complete search history.

(56) References Cited

FOREIGN PATENT DOCUMENTS

| | | |
|---|---|---|
| JP | 52-151683 | 11/1977 |
| JP | 54-11751 | 5/1979 |
| JP | 55-25848 | 2/1980 |
| JP | 56-120148 | 2/1980 |
| JP | 4-40931 | 2/1992 |
| JP | 4-80471 | 7/1992 |
| JP | 04-279136 A | 10/1992 |
| JP | 6-68663 | 9/1994 |

(Continued)

OTHER PUBLICATIONS

Japanese Office Action for Japanese Application No. 2003-274348, mailed on May 20, 2008 (1 page).

(Continued)

*Primary Examiner*—Joseph L Perrin
*Assistant Examiner*—Benjamin Osterhout
(74) *Attorney, Agent, or Firm*—Osha • Liang LLP

(57) ABSTRACT

In the dishwasher, a washing water distribution pipe on which washing nozzles are installed is arranged within a washing chamber, and is connected removably to a first connecting pipe that communicates with the outlet side of a washing pump. In the same way, a rinsing water distribution pipe on which rinsing nozzles are installed is arranged within the washing chamber, and is connected removably to a second connecting pipe that communicates with the outlet side of a rinsing pump. These connections are made within a washing water tank in the bottom of the washing chamber, therefore the washing water distribution pipe and the rinsing water distribution pipe can be easily installed and removed from the washing chamber. Moreover, the washing water distribution pipe and the rinsing water distribution pipe are unitized, so handling is extremely easy.

3 Claims, 14 Drawing Sheets

FOREIGN PATENT DOCUMENTS

| | | |
|---|---|---|
| JP | 2001-238844 | 9/2001 |
| JP | 2002-272665 A | 9/2002 |
| JP | 2003-180597 A | 7/2003 |

OTHER PUBLICATIONS

International Search Report for PCT/JP2005/000391 dated Apr. 26, 2005 (4 pages).
Esp@cenet Patent Abstract for JP2002272665 dated Sep. 24, 2002 (1 page).
Patent Abstract for S54-11751 (Japan) dated May 25, 1979 (2 pages).
Esp@cenet patent abstract for JP4040931 dated Feb. 12, 1992 (1 page).
Patent Abstract for S56-120148 (Japan) dated Feb. 14, 1980 (2 pages).
Chinese Office Action for Chinese Application No. 200580005137.5, mailed on Sep. 5, 2008 (10 pages).
Office Action issued in Japanese Application No. 2003-274348 mailed Jun. 30, 2009, 2 pages.
Patent Abstracts of Japan, Publication No. 04-279136 published Oct. 5, 1992, 1 page.
Patent Abstracts of Japan, Publication No. 2003-180597 published Jul. 2, 2003, 1 page.
Japanese Office Action for Japanese Application No. 2003-274348, mailed on Jan. 20, 2009 (3 pages).
esp@cenet patent abstract for Japanese Publication No. 2001238844, Publication date Sep. 4, 2001 (1 page).

DISH WASHING MACHINE

TECHNICAL FIELD

The present invention relates to a dishwasher that washes and rinses dishes such as plates and cups.

BACKGROUND ART

Conventional dishwashers include dishwashers with nozzles that spray washing water provided in the top and bottom of a washing chamber, and nozzles that spray rinsing water provided in the top and bottom of the washing chamber (for example, see Patent Document 1). In this type of dishwasher, a mechanical chamber is provided below the washing chamber, and the mechanical chamber includes a washing pump for supplying washing water to the washing nozzles, and a rinsing pump for supplying rinsing water to the rinsing nozzles, and so on.

Patent Document 1: Japanese Patent Application Laid-open No. 2002-272665

DISCLOSURE OF THE INVENTION

Problem to be Solved by the Invention

However, in a dishwasher as described above, normally the washing water distribution pipe connected to the washing nozzles and the rinsing water distribution pipe connected to the rinsing nozzles penetrate the walls of the washing chamber and extend into the mechanical chamber (see for example, FIG. 4 of Patent Document 1), so it is very difficult to install and remove the washing water distribution pipe and the rinsing water distribution pipe from the washing chamber side.

Also, in this type of dishwasher, normally the washing water distribution pipe connected to the washing pump and the washing nozzles and the rinsing water distribution pipe connected to the rinsing pump and rinsing nozzles are arranged separately, so the layout of the washing water distribution pipe and the rinsing water distribution pipe within the washing chamber becomes complex, and as a result space within the washing chamber is narrowed and the maintainability of each of the distribution pipes can be reduced.

Therefore, it is an object of the first invention to provide a dishwasher for which the washing water distribution pipe connected to the washing nozzles and the rinsing water distribution pipe connected to the rinsing nozzles can be easily installed and removed from the washing chamber side.

Also, it is an object of the second invention to provide a dishwasher for which the layout of the washing water distribution pipe and the rinsing water distribution pipe can be simplified.

Means for Solving Problem

In order to achieve the above objects, the dishwasher according to the first invention in which dishes are housed in a washing chamber, and washing water is sprayed from washing nozzles to clean the dishes, and rinsing water is sprayed from rinsing nozzles to rinse the dishes in the washing chamber, comprises: a washing water distribution pipe arranged within the washing chamber and on which the washing nozzles are installed; and a rinsing water distribution pipe arranged within the washing chamber and on which the rinsing nozzles are installed and which can be installed integrally with the washing water distribution pipe, wherein the washing water distribution pipe is removably attached to a first connecting pipe connected to the outlet side of a washing water supply pump in a washing water tank in the bottom of the washing chamber, and the rinsing water distribution pipe is removably attached to a second connecting pipe connected to the outlet side of a rinsing water supply pump in the washing water tank.

In this dishwasher, the washing water distribution pipe on which the washing nozzles are installed are arranged in the washing chamber, and removably attached to the first connecting pipe which either directly or indirectly communicates with the outlet side of the washing water supply pump. Similarly, the rinsing water distribution pipe on which the rinsing nozzles are installed are arranged in the washing chamber, and removably attached to the second connecting pipe which either directly or indirectly communicates with the outlet side of the rinsing water supply pump. Here, connecting the washing water distribution pipe and the first connecting pipe, and connecting the rinsing water distribution pipe and the second connecting pipe is carried out in the washing water tank in the bottom of the washing chamber, so the washing water distribution pipe and the rinsing water distribution pipe can be easily attached and removed from the washing chamber side. Moreover, the washing water distribution pipe and the rinsing water distribution pipe are integrated, so handling is extremely easy. Therefore, the ease of assembly during manufacture and the maintainability of the piping or within the washing water tank can be improved.

Also, it can be desirable to arrange the rinsing water distribution pipe within the washing water distribution pipe, and arrange the second connecting pipe within the first connecting pipe. In this way the space taken by the washing water distribution pipe and the rinsing water distribution pipe within the washing chamber can be minimized.

Also, it can be desirable to provide the first connecting pipe on a casing that houses the impeller of the washing water supply pump, and to extend the second connecting pipe from within the first connecting pipe through the casing to the outside, and connect the second connecting pipe to the outlet side of the rinsing water supply pump. By adopting this type of washing water supply pump, a double structure distribution pipe with the rinsing water distribution pipe arranged within the washing water distribution pipe can be conveniently adopted.

Also, it can be desirable to arrange a removably attached casing that houses the impeller of the washing water supply pump within the washing water tank, and to connect the washing water distribution pipe to the first connecting pipe provided on the casing. In this way, by arranging the casing of the washing water supply pump within the washing water tank, the number of components is reduced, and space can be saved. Moreover, the casing can be removed from the washing chamber side, so maintenance of the impeller within the casing can be easily carried out.

In order to achieve the above objects, the dishwasher according to the second invention in which dishes are housed in a washing chamber, and washing water is sprayed from washing nozzles to clean the dishes, and rinsing water is sprayed from rinsing nozzles to rinse the dishes in the washing chamber, comprises: a washing water distribution pipe connected at one end thereof to the washing nozzles; a rinsing water distribution pipe arranged within the washing water distribution pipe and connected at one end thereof to the rinsing nozzles, wherein the other end of the washing water distribution pipe is connected to a washing water outlet provided on a casing of a washing water supply pump, and the rinsing water distribution pipe passes through the washing water outlet, penetrates the casing, and the other end of the rinsing water distribution pipe is connected to a rinsing water outlet of a rinsing water supply pump.

In this dishwasher, the rinsing water distribution pipe that connects the rinsing water supply pump and the rinsing nozzles is arranged within the washing water distribution pipe that connects the washing water supply pump and the washing nozzles, and furthermore, the rinsing water distribution pipe penetrates the casing of the washing water supply pump via the washing water outlet. In this way, a double structure distribution pipe formed from the washing water distribution pipe and the rinsing water distribution pipe is arranged from the washing water supply pump to each nozzle, so the layout of the washing water distribution pipe and the rinsing water distribution pipe can be simplified.

Also, it is desirable that the washing water distribution pipe has an upstream side washing water distribution pipe connected to the washing water outlet and a downstream side washing water distribution pipe connected to the washing nozzles, and the upstream side washing water distribution pipe and the downstream side washing water distribution pipe are connected to be freely installed and removed from within the washing chamber, and the rinsing water distribution pipe has an upstream side rinsing water distribution pipe connected to the rinsing water outlet and a downstream side rinsing water distribution pipe connected to the rinsing nozzles, and the upstream side rinsing water distribution pipe and the downstream side rinsing water distribution pipe are connected to be freely installed and removed from within the washing chamber. In this way, the connection between the upstream side washing water distribution pipe and the downstream side washing water distribution pipe and the connection between the upstream side rinsing water distribution pipe and the downstream side rinsing water distribution pipe can be carried out from within the washing chamber so that the connections can be freely attached and detached, so the downstream side washing water distribution pipe and the downstream side rinsing water pipe can be easily attached and removed from the washing water side. Moreover, the downstream side washing water distribution pipe and the downstream side rinsing water distribution pipe are integrated in a double structure distribution pipe, so the downstream side washing water distribution pipe and the downstream side rinsing water distribution pipe can be handled extremely easily. Therefore, it is possible to improve the operability of installation of the downstream side washing water distribution pipe and the downstream side rinsing water distribution pipe and the maintainability.

Effect of the Invention

According to the first invention, the washing water distribution pipe on which the washing nozzles are installed and the rinsing water distribution pipe on which the rinsing nozzles are installed can be easily installed and removed from the washing chamber side.

Also, according to the second invention, the layout of the washing water distribution pipe and the rinsing water distribution pipe can be simplified.

EXPLANATIONS OF NUMERALS

1 . . . dishwasher; 3 . . . washing chamber; 12 . . . upper washing nozzle (washing nozzle); 13 . . . upper rinsing nozzle (rinsing nozzle); 14 . . . lower washing nozzle (washing nozzle); 15 . . . lower rinsing nozzle (rinsing nozzle); 17 . . . washing water tank; 19 . . . washing water supply pump; 21 . . . washing water distribution pipe; 24 . . . rinsing water supply pump; 28 . . . impeller; 29 . . . casing; 31 . . . first connecting pipe; 33 . . . second connecting pipe; 101 . . . dishwasher; 103 . . . washing chamber; 112 . . . upper washing nozzle (washing nozzle); 113 . . . upper rinsing nozzle (rinsing nozzle); 114 . . . lower washing nozzle (washing nozzle); 115 . . . lower rinsing nozzle (rinsing nozzle); 119 . . . washing water supply pump; 124 . . . rinsing water supply pump; 132 . . . washing water outlet; 133 . . . casing; 136 . . . rinsing water outlet; 160 . . . washing water distribution pipe; 161 . . . upstream side washing water distribution pipe; 162 . . . downstream side washing water distribution pipe; 170 . . . rinsing water distribution pipe; 171 . . . upstream side rinsing water distribution pipe; 172 . . . downstream side rinsing water distribution pipe.

BEST MODES FOR CARRYING OUT THE INVENTION

First Embodiment

The following is a detailed description of the preferred embodiment of a dishwasher according to the first invention, with reference to the drawings.

Figure 1:
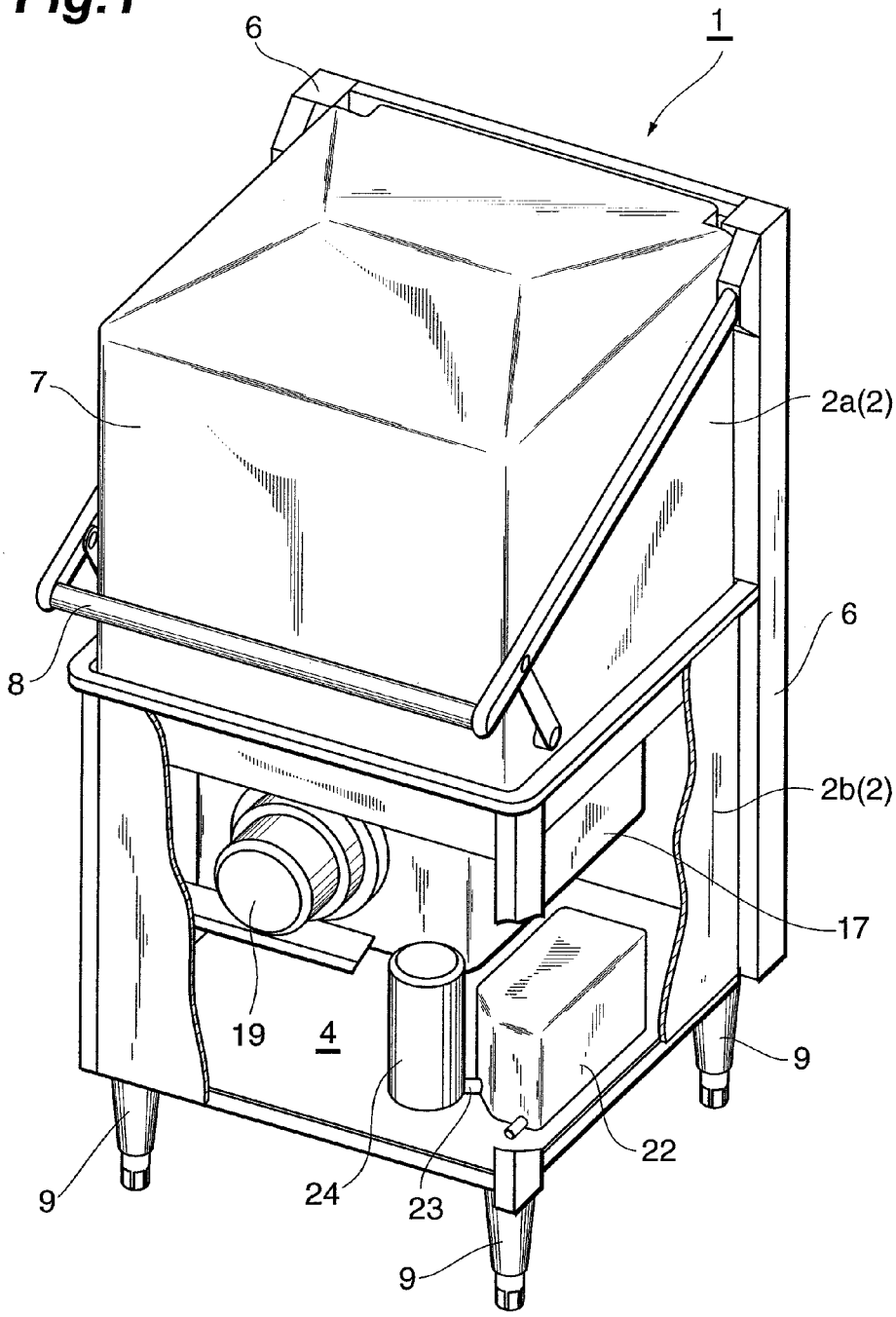
FIG. 1 is an isometric view of an embodiment of the dishwasher according to the first invention.
Figure 2:
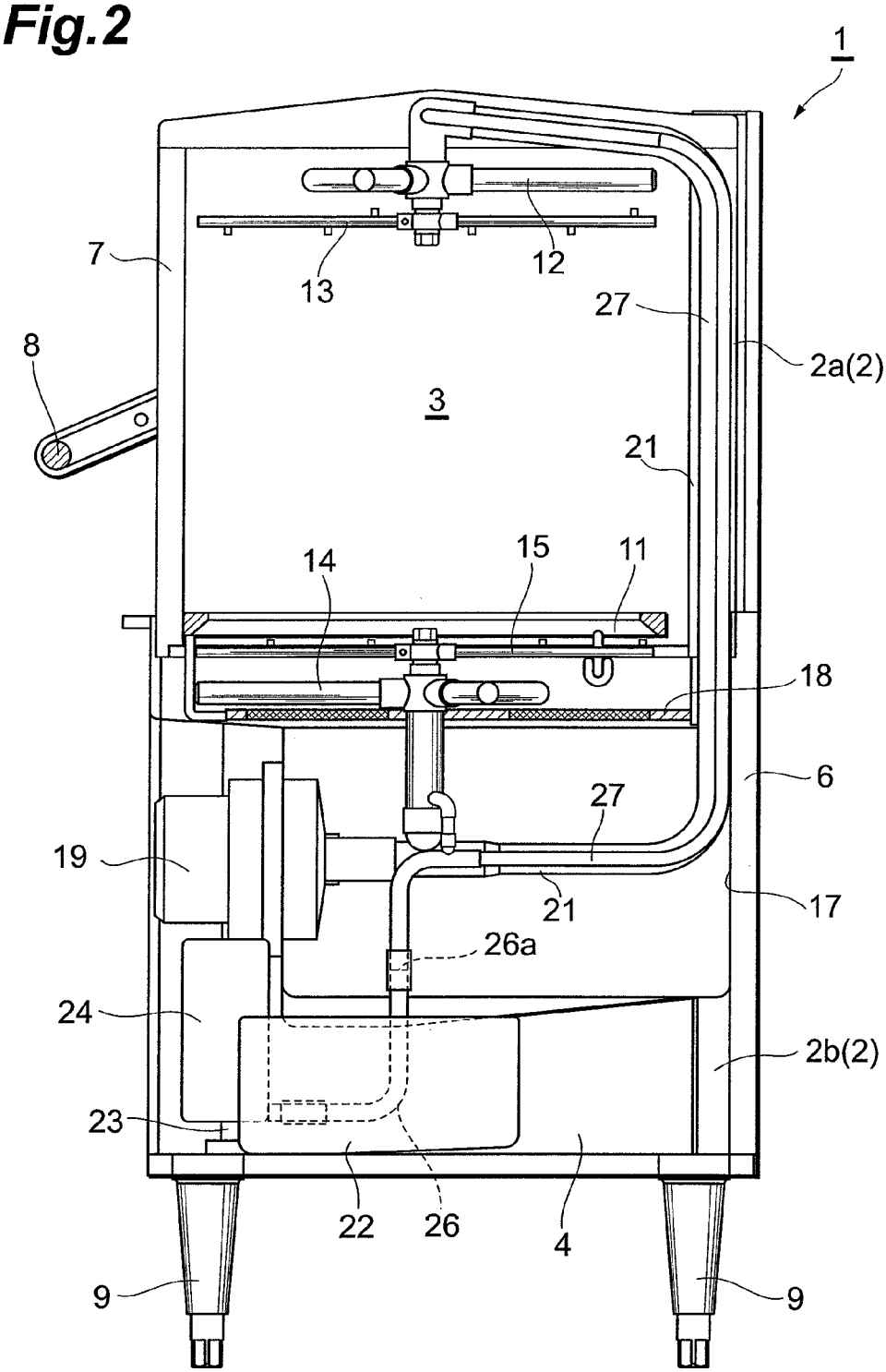
FIG. 2 is a side view of the interior of the dishwasher of FIG. 1.

As shown in FIGS. 1 and 2, the dishwasher 1 has a stainless steel washer main body 2. The washer main body 2 is divided into an upper portion 2*a* forming a washing chamber 3, and a lower portion 2*b* forming a mechanical chamber 4, and a pair of support columns 6 extend between the upper portion 2*a* and the lower portion 2*b* in the corners of the rear of the washer main body 2. Also, a box-shaped door 7 is provided in the upper portion 2*a* of the washer main body 2 for opening and closing the washing chamber 3. The door 7 is freely guided in the vertical direction by the pair of support columns 6, and opening and closing the washing chamber 3 is carried out by moving in the vertical direction a handle 8 that extends horizontally. Legs 9 are provided in the four corners of the bottom surface of the washer main body 2, so that the dishwasher 1 can be stably installed.

A rack rail 11 that can be freely inserted and removed is installed in the washing chamber 3, and above the rack rail 11 a lattice-shaped dish rack (not shown in the drawings) is mounted in which dishes are arranged after being used. Furthermore, in the top of the inside of the washing chamber 3 an upper washing nozzle 12 having three arms extending in a radial direction, and an upper rinsing nozzle 13 having two arms extending in a straight line are installed so that they can freely rotate about the same axis. In the same way, in the bottom of the inside of the washing chamber 3 a lower washing nozzle 14 and a lower rinsing nozzle 15 are installed so that they can freely rotate about the same axis.

In the bottom of the washing chamber 3 configured in this way, a washing water tank 17 is formed continuously projecting into the mechanical chamber 4, and a removable filter 18 is installed between the washing chamber 3 and the washing water tank 17. In the front surface of the washing water tank 17 a washing water supply pump (hereafter referred to as the "washing pump") 19 is installed so that the inlet and outlet are positioned within the washing water tank 17, thereby the reduction in the number of components and space is achieved. A washing water distribution pipe 21 is connected to the outlet of the washing water pump 19, and the washing water distribution pipe 21 passes through the washing water tank 17 and the washing chamber 3 and is connected to the upper washing nozzle 12 and the lower washing nozzle 14.

Furthermore, a rinsing water tank 22 that is supplied with rinsing water by an external hot water heater (not shown in the drawings) is housed in the mechanical chamber 4, and a rinsing water supply pump (hereafter referred to as the "rinsing pump") 24 is connected to the rinsing water tank 22 via inlet piping 23. The rinsing pump 24 is installed vertically with the impeller to the bottom (in other words, with the motor to the top), so that space within the mechanical chamber 4 is effectively utilized. An outlet pipe 26 is connected to the outlet of the rinsing pump 24, and an end 26*a* of the outlet pipe 26 extends inside the washing water tank 17. Also, a rinsing water distribution pipe 27 is connected to the end 26*a* of the outlet pipe 26, and the rinsing water distribution pipe 27 passes through the washing water tank 17 and the washing chamber 3 and is connected to the upper rinsing nozzle 13 and the lower rinsing nozzle 15. An electrical equipment box (not shown in the drawings) that contains a microcomputer or similar that controls the overall operation of the dishwasher 1 is housed within the mechanical chamber 4.

Here the operation of the dishwasher 1 described above is explained. When the operation start button is turned ON the washing pump 19 starts. As a result of this, washing water stored in the washing water tank 17 is transmitted through the washing water distribution pipe 21 to the upper and lower washing nozzles 12, 14, and is sprayed from each washing nozzle 12, 14 onto the dishes. At this time, each washing nozzle 12, 14 rotates in reaction to the spraying washing water, so the washing water is applied thoroughly to the dishes, thereby efficiently washing the dirt from the dishes. Remains of vegetables and other dirt washed off the dishes is removed from the washing water that has been sprayed onto the dishes by the filter 18 and the washing water is recovered into the washing water tank 17, where it is circulated by the washing pump 19.

Washing of dishes in this way is carried out for a predetermined period of time, then the washing pump 19 stops, and the rinsing pump 24 starts. As a result, the rinsing water stored in the rinsing water tank 22 is transmitted through the rinsing water distribution pipe 27 to the upper and lower rinsing nozzles 13, 15, and is sprayed from each rinsing nozzle 13, 15 onto the dishes. At this time, each rinsing nozzle 13, 15 rotates in reaction to the spraying rinsing water, so the rinsing water is applied thoroughly to the dishes, thereby efficiently rinsing the dishes. The rinsing water sprayed on the dishes passes through the filter 18 and is recovered in the washing water tank 17, where it will be used as washing water the next time dishes are washed. Rinsing of dishes in this way is carried out for a predetermined period of time, then the rinsing pump 24 stops, and one cycle of operation of the dishwasher 1 is completed.

Figure 3:
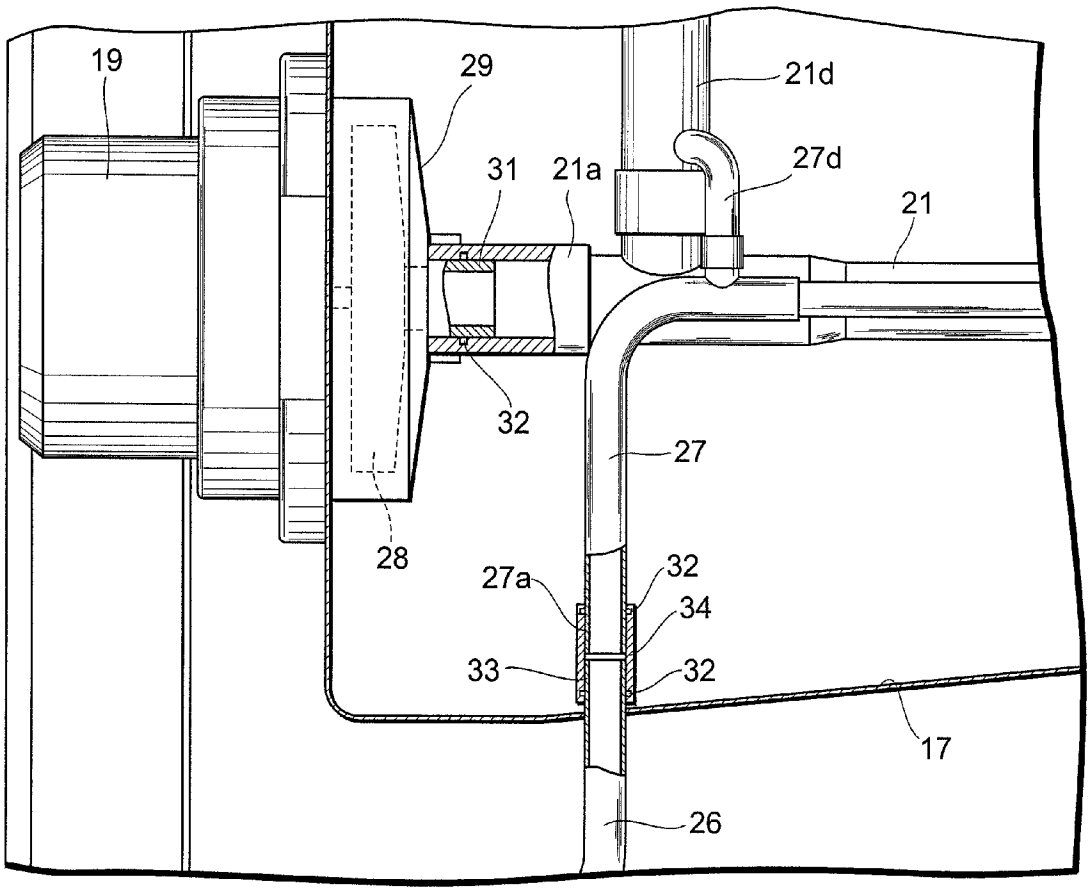
FIG. 3 is an enlarged view of part of the dishwasher of FIG. 2.

Next, the washing water distribution pipe 21 and the rinsing water distribution pipe 27 are explained in more detail. As shown in FIG. 3, an upstream end 21*a* of the washing water distribution pipe 21 is inserted into a first connecting pipe 31 formed in the outlet of a casing 29 housing an impeller 28 of the washing pump 19. An O-ring 32 is fitted to the inner wall surface of the upstream end 21*a*, so the upstream end 21*a* and the first connecting pipe 31 are connected in a watertight manner that can be freely attached and removed. The first connecting pipe 31 and the washing water distribution pipe 21 may be joined by application of pressure with a screw or another method.

Figure 4:
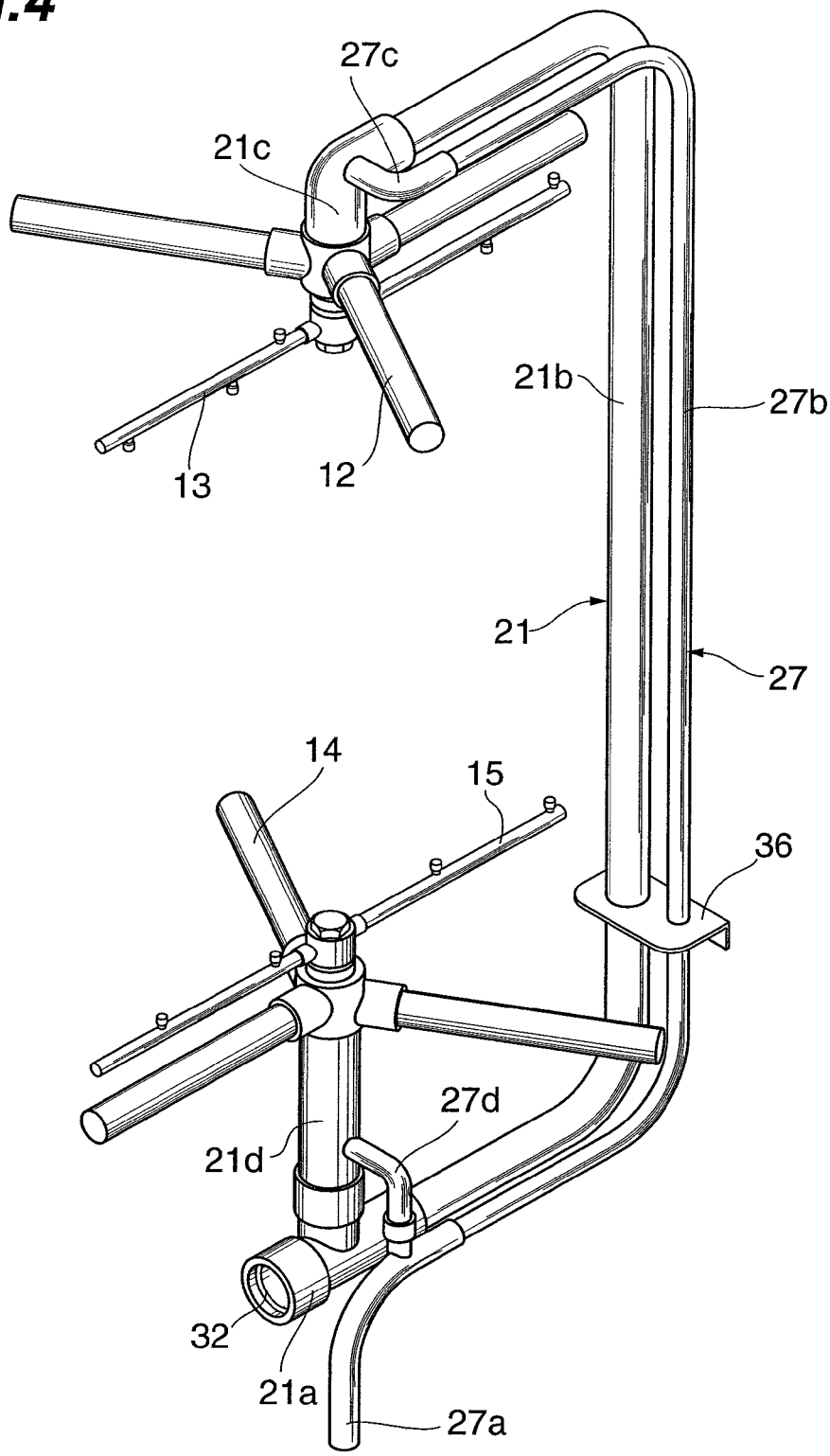
FIG. 4 is an isometric view of the washing water distribution pipes and rinsing water distribution pipes.

As shown in FIG. 4, the washing water distribution pipe 21 has a main line portion 21*b* from the upstream end 21*a* passing through the rear of the washing chamber 3 to the top portion of the interior of the washing chamber 3, and an upper upstand 21*c* pointing directly downwards in the center of the top portion. Furthermore, the washing water distribution pipe 21 has a lower upstand 21*d* directly below the upper upstand 21*c* branching from the main line portion 21*b* and pointing directly upwards. Also, the upper washing nozzle 12 and the upper rinsing nozzle 13 are fitted to the upper upstand 21*c* so that they can freely rotate, and the upper upstand 21*c* communicates with the upper washing nozzle 12. In the same way, the lower washing nozzle 14 and the lower rinsing nozzle 15 are fitted to the lower upstand 21*d* so that they can freely rotate, and the lower upstand 21*d* communicates with the lower washing nozzle 14.

Also, as shown in FIG. 3, a second connecting pipe 33 which is the downstream end of the outlet pipe 26 connected to the outlet side of the rinsing pump 24 projects into the washing water tank 17, and the second connecting pipe 33 is joined to the upstream end 27*a* of the rinsing water distribution pipe 27 by a connecting member 34. The upstream end 27*a* and the second connecting pipe 33 are inserted into the ends of the connecting member 34, but an O-ring 32 is fitted to the internal wall of the connecting member 34, so the upstream end 27*a* and the second connecting pipe 33 are connected in a liquid-tight manner so that they can be freely attached and removed. The second connecting pipe 33 and the rinsing water distribution pipe 27 may be joined by application of pressure with a screw or another method.

As shown in FIG. 4, the rinsing water distribution pipe 27 has a main line portion 27*b* that extends along the main line portion 21*b* of the washing water distribution pipe 21 in the washing chamber 3, and a downstream end 27*c* of the main line portion 27*b* that penetrates into the upper upstand 21*c* of the washing water distribution pipe 21, and communicates with the upper rinsing nozzle 13. Furthermore, the rinsing water distribution pipe 27 has a branching portion 27*d* that branches from the main line portion 27*b* below the downstream end 27*c*, and the branching portion 27*d* penetrates into the lower upstand 21*d* of the washing water distribution pipe 21, and communicates with the lower rinsing nozzle 15.

In this way, the downstream end 27*c* of the rinsing water distribution pipe 27 penetrates into the upper upstand 21*c* of the washing water distribution pipe 21, and the branching portion 27*d* of the rinsing water distribution pipe 27 penetrates into the lower upstand 21*d* of the washing water distribution pipe 21, so the rinsing water distribution pipe 27 is fitted integrally to the washing water distribution pipe 21 (in other words, the rinsing water distribution pipe 27 and the washing water distribution pipe 21 are unitized). Also, the main line portion 21*b* of the washing water distribution pipe 21 and the main line portion 27*b* of the rinsing water distribution pipe 27 are connected by a plate shaped bracket 36. The bracket 36 is fixed to the rear surface of the washing chamber 3, so the washing water distribution pipe 21 and the rinsing water distribution pipe 27 are held in a stable condition within the washing chamber 3.

As described above, in the dishwasher 1, the washing water distribution pipe 21 on which the upper and lower washing nozzles 12, 14 are fitted is arranged within the washing chamber 3, and is connected to the first connecting pipe 31 which communicates with the outlet side of the washing pump 19 so that the washing water distribution pipe 21 can be freely attached and removed. In the same way, the rinsing water distribution pipe 27 on which the upper and lower rinsing nozzles 13, 15 are fitted is arranged within the washing chamber 3, and is connected to the second connecting pipe 33 which communicates with the outlet side of the rinsing pump 24 so that the rinsing water distribution pipe 27 can be freely attached and removed. Here, the connection between the washing water distribution pipe 21 and the first connecting pipe 31 and the connection between the rinsing water distribution pipe 27 and the second connecting pipe 33 are carried out in the washing water tank 17 in the bottom of the washing chamber 3, so the washing water distribution pipe 21 and the rinsing water distribution pipe 27 can be easily inserted and removed from the washing chamber 3 side. Moreover, the washing water distribution pipe 21 and the rinsing water distribution pipe 27 are unitized, so handling can be made very easy.

Removal of the washing water distribution pipe 21 and the rinsing water distribution pipe 27 is carried out by the following procedure. First the bracket 36 is removed from the rear surface of the washing chamber 3. Then, the connecting member 34 is slid towards the rinsing water distribution pipe 27 side, and the connection of the second connecting pipe 33 and the rinsing water distribution pipe 27 is dismantled. Then, the first connecting pipe 31 that is inserted into the upstream end 21*a* of the washing water distribution pipe 21 is removed, and the connection between the first connecting pipe 31 and the washing water distribution pipe 21 is dismantled. In this way, removal of the washing water distribution pipe 21 and the rinsing water distribution pipe 27 is completed. Installation of the washing water distribution pipe 21 and the rinsing water distribution pipe 27 is reverse of the procedure described above.

Figure 5:
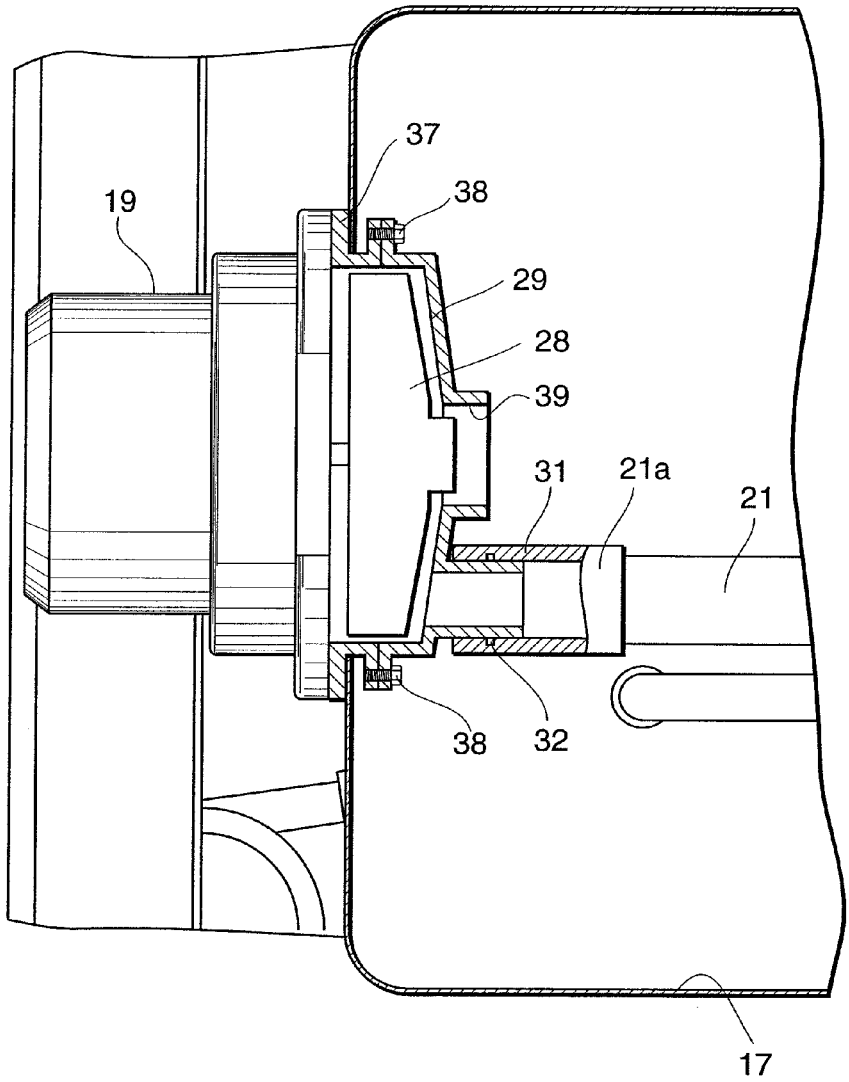
FIG. 5 is a cross-section view showing the first embodiment of the washing pump.
Figure 6:
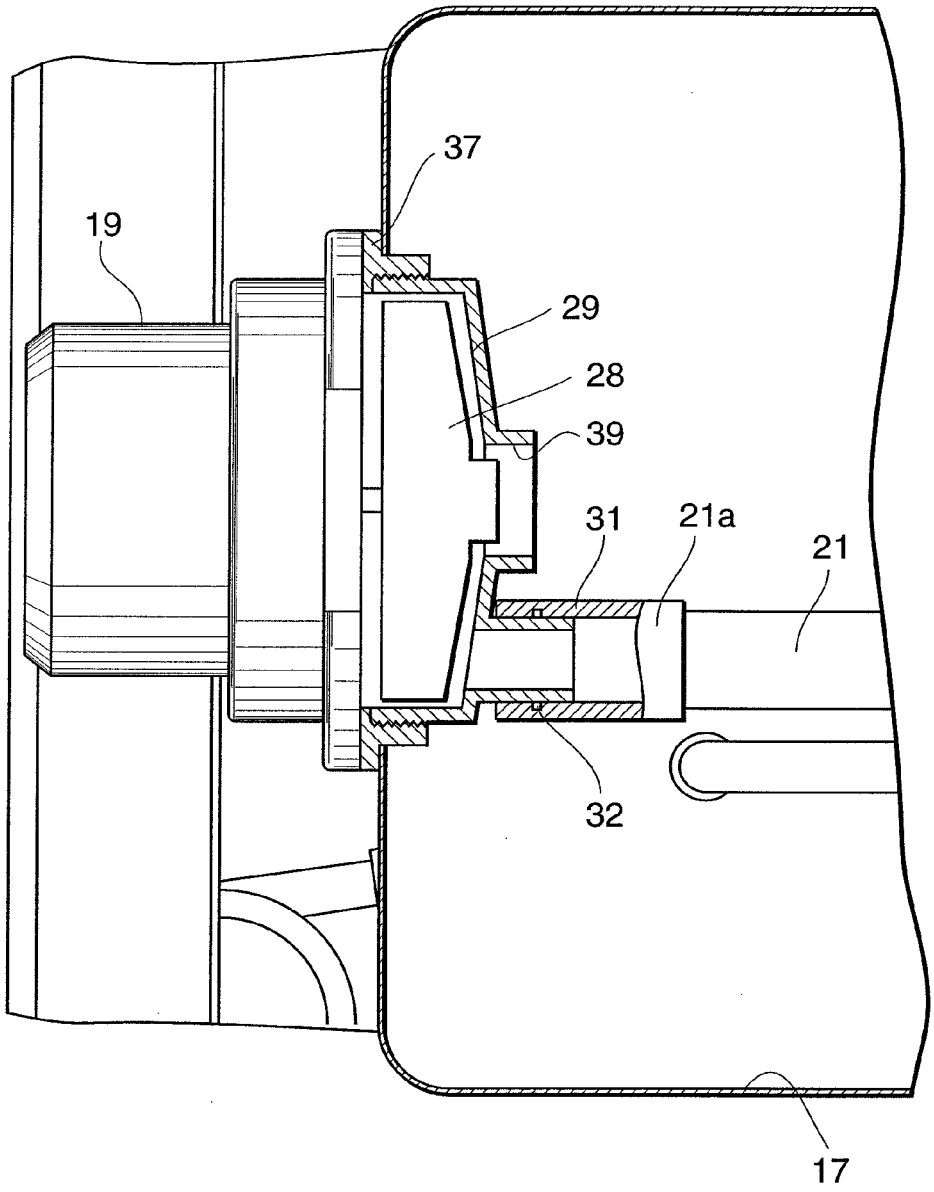
FIG. 6 is a cross-section view showing the second embodiment of the washing pump.

Also, as shown in FIGS. 5 and 6, the casing 29 that houses the impeller 28 of the washing pump 19 is disposed within the washing water tank 17. The casing 29 is installed on a casing receiver 37 so that the casing 29 can be freely attached and removed. For example, as shown in FIG. 5, the casing 29 may be fixed to the casing receiver 37 using fixing bolts 38. Also, as shown in FIG. 6, the casing 29 may be fitted to the casing receiver 37 by forming threads on the outer perimeter of the casing 29 and on the internal surface of the casing receiver 37 so that they can be screwed together. By adopting this type of configuration, the casing 29 can be removed from the washing chamber 3 side, so that maintenance and so on of the impeller 28 within the casing 29 can be easily carried out. An inlet 39 is formed in the center of the casing 29.

Figure 7:
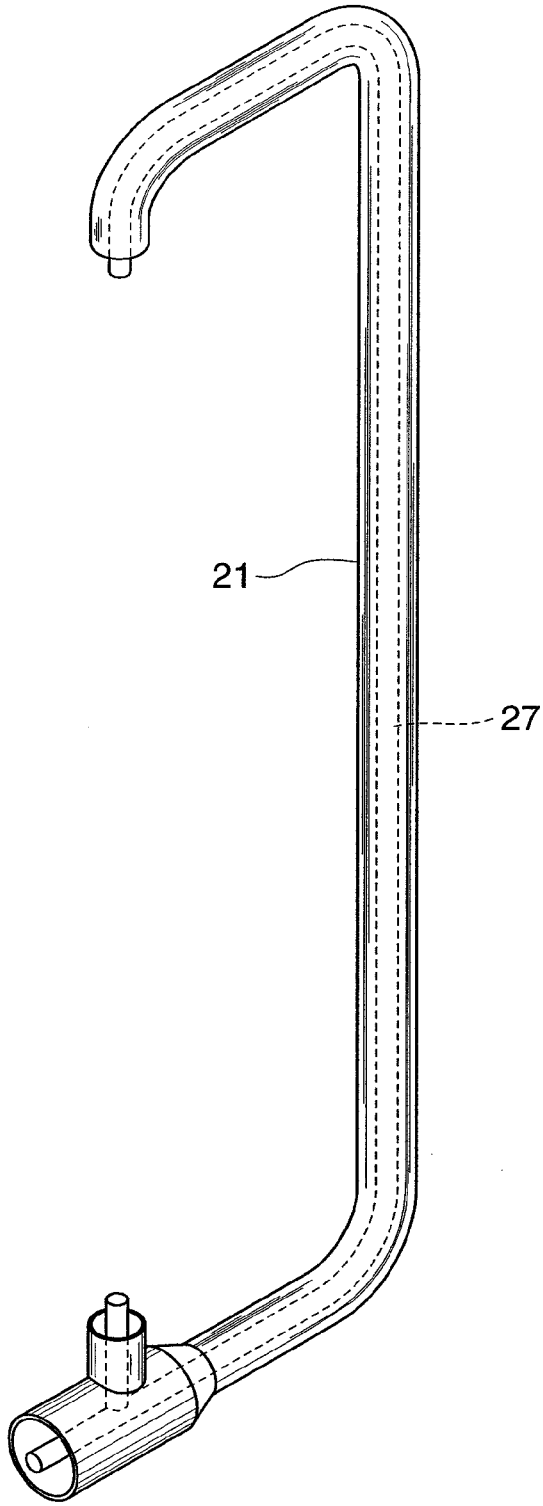
FIG. 7 is an isometric view of the double-structure distribution pipes.

However, the first invention is not limited to the embodiment described above. For example, as shown in FIG. 7, the distribution pipes may be configured in a double structure, with the rinsing water distribution pipe 27 inside the washing water distribution pipe 21. If this type of double structure distribution pipe is adopted, the space occupied by the washing water distribution pipe 21 and the rinsing water distribution pipe 27 within the washing chamber 3 can be reduced.

Figure 8:
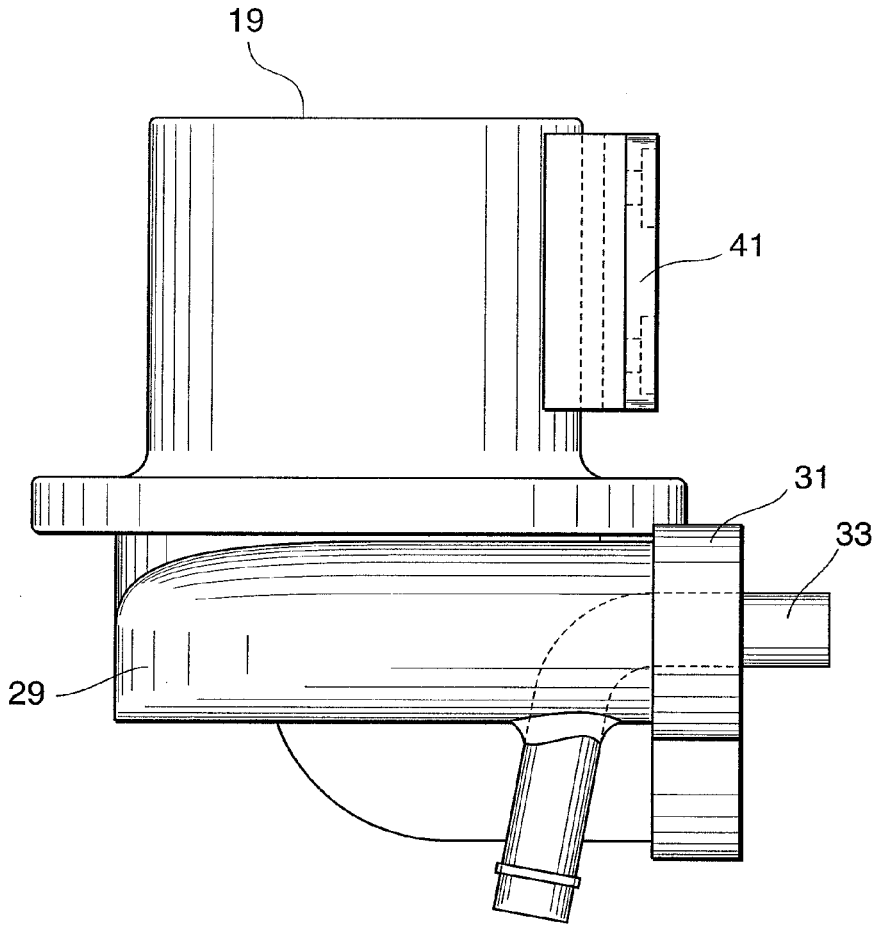
FIG. 8 is a front elevation of a washing pump adapted to double-structure distribution pipes.
Figure 9:
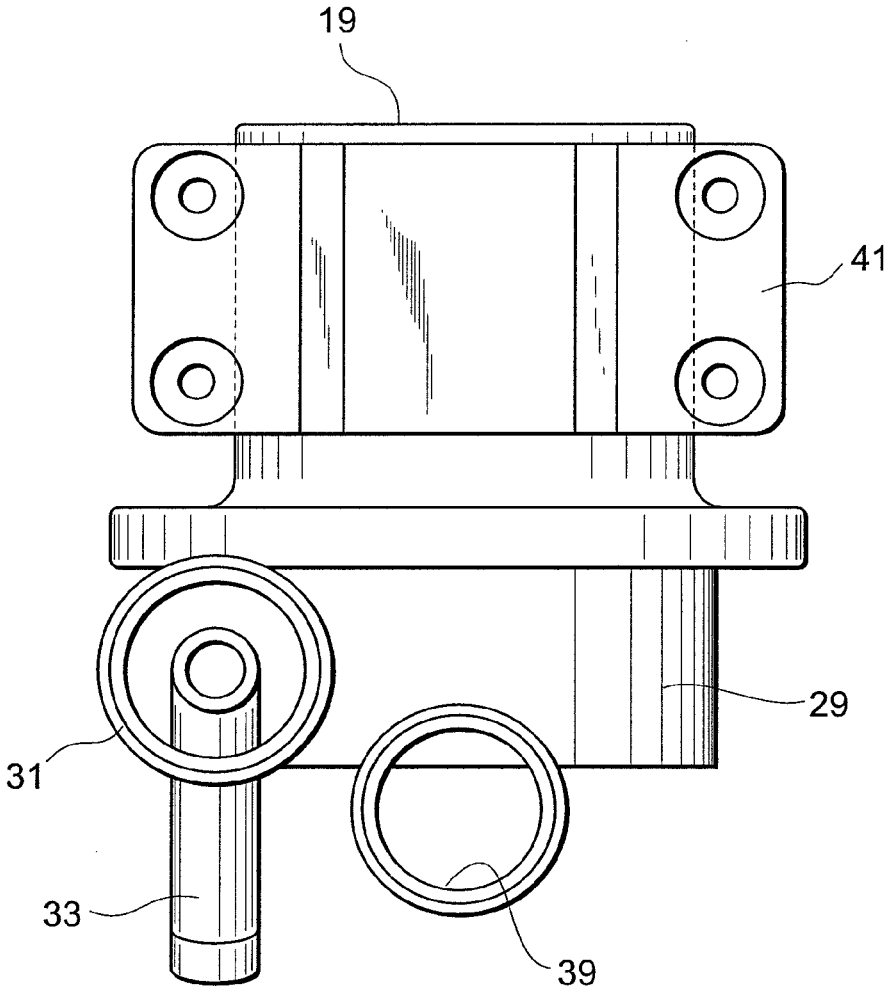
FIG. 9 is a side view of the washing pump of FIG. 8.

In this case the second connecting pipe 33 may be arranged inside the first connecting pipe 31, but if a double structure distribution pipe is to be directly connected to the outlet of the casing 29 of the washing pump 19, the washing pump 19 should be configured as follows. In other words, as shown in FIGS. 8 and 9, the casing 29 of the washing pump 19 may be provided with the first connecting pipe 31, and the second connecting pipe 33 passes from within the first connecting pipe 31 through the casing 29 and extends outwards and may be connected to the outlet side of the rinsing pump 24. By adopting this type of washing pump 19, a double structure distribution pipe in which the rinsing water distribution pipe 27 is arranged within the washing water distribution pipe 21 can be easily applied. The washing pump 19 shown in FIGS. 8 and 9 is arranged vertically with the impeller below (in other words, with the motor above), and is installed on the side wall of the washing water tank 17 via a bracket 41.

Also, in the embodiment described above, the first connecting pipe 31 is provided on the side wall side of the washing water tank 17, and the second connecting pipe 33 is provided on the bottom wall side of the washing water tank 17, but the arrangement position of each connecting pipe 31, 33 is not limited to positions such as the side wall side or the bottom wall side of the washing water tank 17, provided that they can be connected to the washing water distribution pipe 21 or the rinsing water distribution pipe 27 within the washing water tank 17.

Second Embodiment

The following is a detailed description of the preferred embodiment of a dishwasher according to the second invention, with reference to the drawings.

Figure 10:
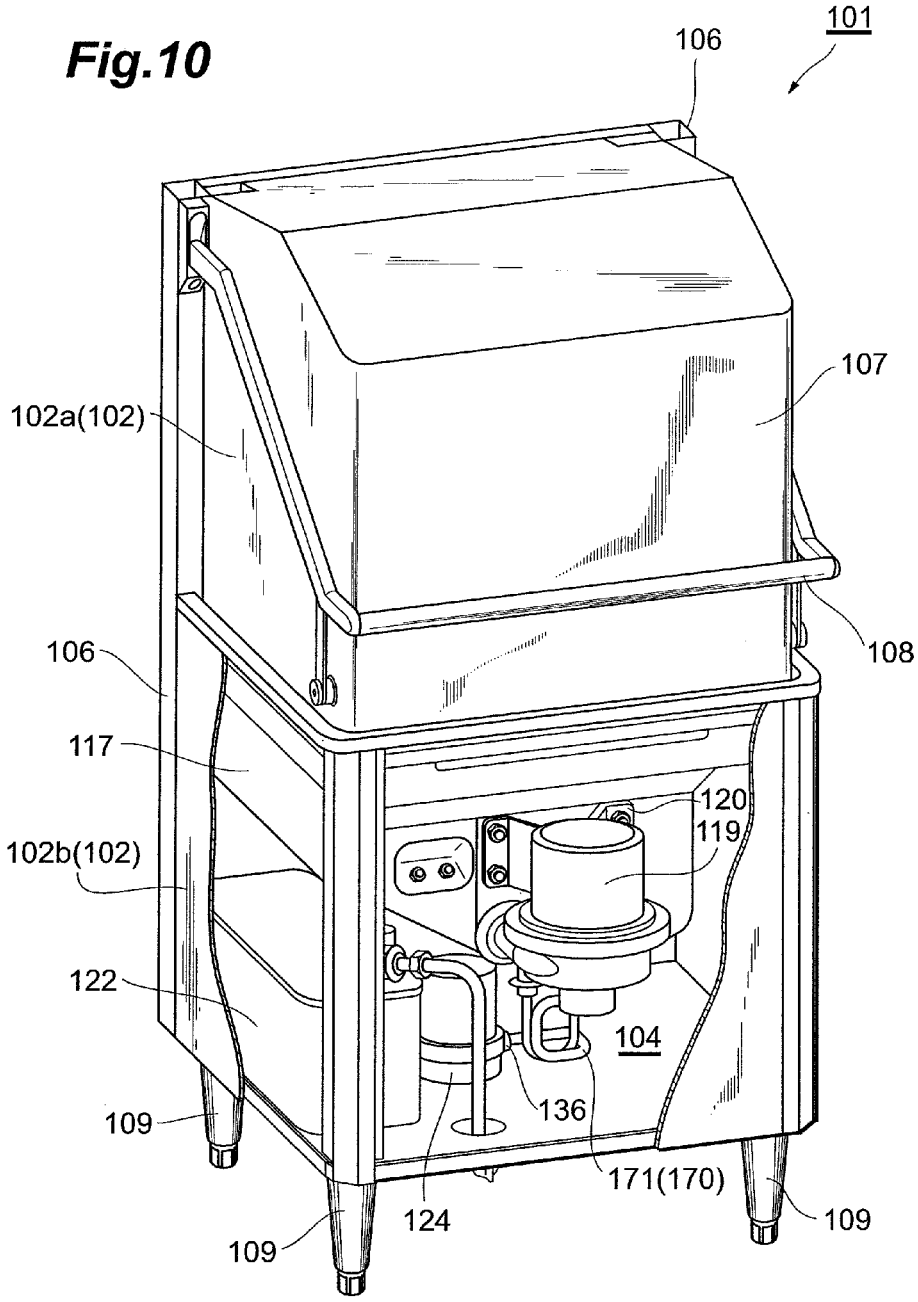
FIG. 10 is an isometric view of an embodiment of the dishwasher according to the second invention.
Figure 11:
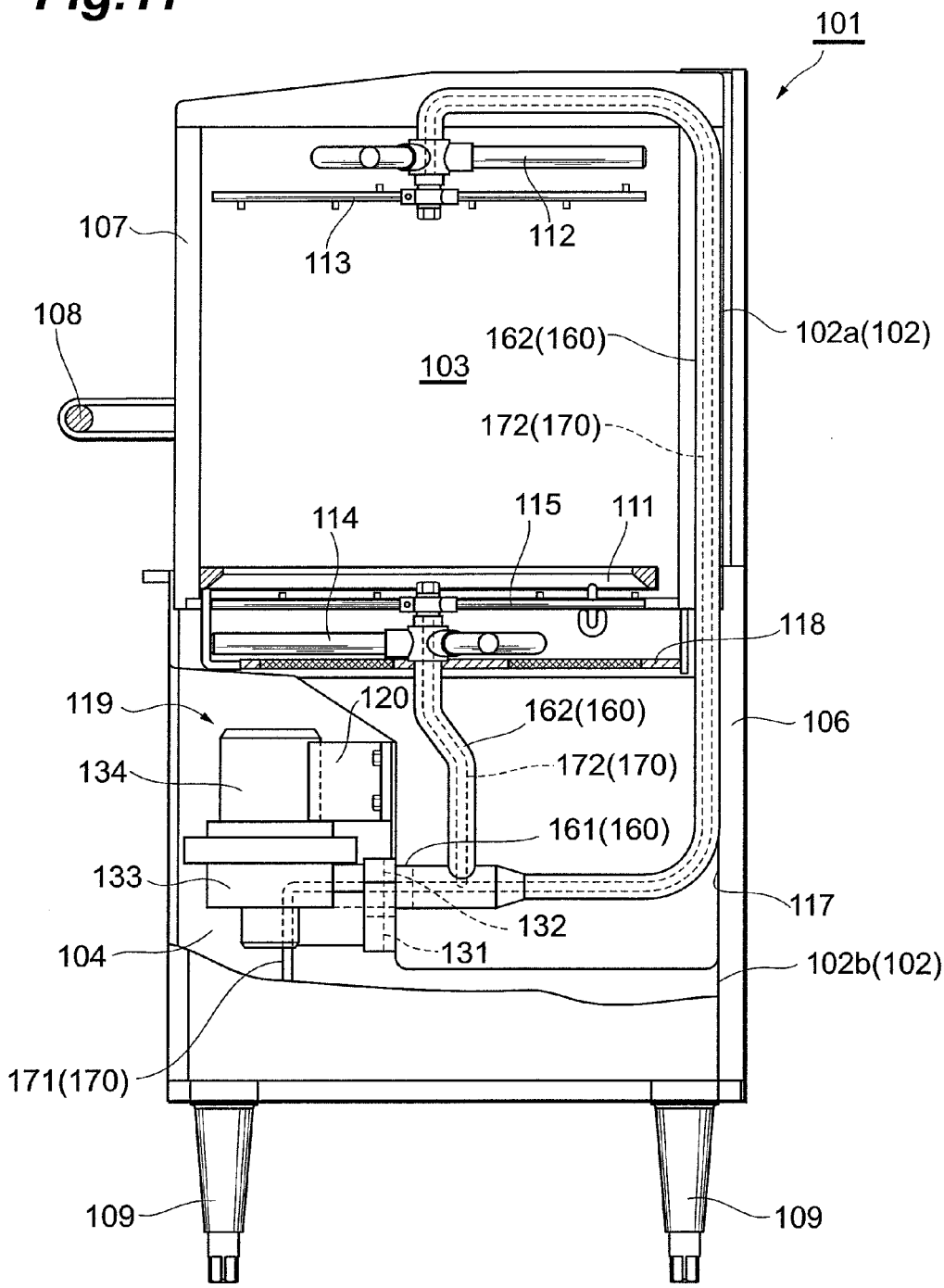
FIG. 11 is a side view of the interior of the dishwasher of FIG. 10.

As shown in FIGS. 10 and 11, the dishwasher 101 has a stainless steel washer main body 102. The washer main body 102 is divided into an upper portion 102*a* forming a washing chamber 103, and a lower portion 102*b* forming a mechanical chamber 104, and a pair of support columns 106 extends between the upper portion 102*a* and the lower portion 102*b* in the corners of the rear of the washer main body 102. Also, a box-shaped door 107 is provided in the upper portion 102*a* of the washer main body 102 for opening and closing the washing chamber 103. The door 107 is freely guided in the vertical direction by the pair of support columns 106, and opening and closing the washing chamber 103 is carried out by moving in the vertical direction a handle 108 that extends horizontally. Legs 109 are provided in the four corners of the bottom surface of the washer main body 102, so that the dishwasher 101 can be stably installed.

A rack rail 111 is removably installed in the washing chamber 103, and above the rack rail 111 a lattice-shaped dish rack (not shown in the drawings) is mounted in which dishes are arranged after being used. Furthermore, in the top of the inside of the washing chamber 103 an upper washing nozzle 112 having three arms extending in a radial direction, and an upper rinsing nozzle 113 having two arms extending in a straight line are installed so that they can freely rotate about the same axis. In the same way, in the bottom of the inside of the washing chamber 103 a lower washing nozzle 114 and a lower rinsing nozzle 115 are installed so that they can freely rotate about the same axis.

In the bottom of the washing chamber 103 configured in this way, a washing water tank 117 is formed continuously projecting into the mechanical chamber 104, and a removable filter 118 is installed between the washing chamber 103 and the washing water tank 117. In the front surface of the washing water tank 117 a washing water supply pump (hereafter referred to as the "washing pump") 119 is installed via a bracket 120 so that a washing water inlet 131 and a washing water outlet 132 are within the washing water tank 117. The washing water outlet 132 of the washing pump 119 and each of the washing nozzles 112, 114 are connected by a washing water distribution pipe 160 that passes through the washing water tank 117 and the washing chamber 103. The washing water distribution pipe 160 includes an upstream side washing water distribution pipe 161 connected to the washing water outlet 132 and a downstream side washing water distribution pipe 162 connected to each washing nozzle 112, 114. The washing pump 119 is placed vertically with a casing 133 that houses the impeller facing downwards (in other words, with a motor 134 facing upwards), and installed within the washing water tank 117 so that the washing water inlet 131 and the washing water outlet 132 open into the washing water tank 117, so space in the mechanical chamber 104 can be efficiently utilized.

Furthermore, a rinsing water tank 122 that is supplied with rinsing water by an external hot water heater (not shown in the drawings) is housed in the mechanical chamber 104, and the rinsing water tank 122 is connected to a rinsing water inlet (not shown in the drawings) of a rinsing water supply pump (hereafter referred to as the "rinsing pump") 124 via a connecting pipe (not shown on the drawings). The rinsing pump 124 is installed vertically with the casing that houses the impeller to the bottom (in other words, with the motor to the top), so that space within the mechanical chamber 104 is effectively utilized. A rinsing water outlet 136 of the rinsing pump 124 and each rinsing nozzle 113, 115 are connected by a rinsing water distribution pipe 170 that passes at least partially through the washing water distribution pipe 160, the rinsing water distribution pipe 170 passes from within the washing water distribution pipe 160 through the washing water outlet 132 and penetrates the casing 133 of the washing pump 119. The rinsing water distribution pipe 170 includes an upstream side rinsing water distribution pipe 171 connected to the rinsing water outlet 136 and a downstream side rinsing water distribution pipe 172 connected to each nozzle 113, 115. An electrical equipment box (not shown in the drawings) that contains a microcomputer or similar that controls the overall operation of the dishwasher 101 is housed within the mechanical chamber 104.

Here the operation of the dishwasher 101 described above is explained. When the operation start button is turned ON the washing pump 119 starts. As a result of this, washing water stored in the washing water tank 117 is transmitted through the washing water distribution pipe 160 to the upper and lower washing nozzles 112, 114, and is sprayed from each washing nozzle 112, 114 onto the dishes. At this time, each washing nozzle 112, 114 rotates in reaction to the spraying washing water, so the washing water is applied thoroughly to the dishes, thereby efficiently washing the dirt from the dishes. Remains of vegetables and other dirt washed off the dishes is removed from the washing water that has been sprayed onto the dishes by the filter 118 and the washing water is recovered into the washing water tank 117, where it is circulated by the washing pump 119.

Washing of dishes in this way is carried out for a predetermined period of time, then the washing pump 119 stops, and the rinsing pump 124 starts. As a result, the rinsing water stored in the rinsing water tank 122 is transmitted through the rinsing water distribution pipe 170 to the upper and lower rinsing nozzles 113, 115, and is sprayed from each rinsing nozzle 113, 115 onto the dishes. At this time, each rinsing nozzle 113, 115 rotates in reaction to the spraying rinsing water, so the rinsing water is applied thoroughly to the dishes, thereby efficiently rinsing the dishes. The rinsing water sprayed on the dishes passes through the filter 118 and is recovered in the washing water tank 117, where it will be used as washing water the next time dishes are washed. Rinsing of dishes in this way is carried out for a predetermined period of time, then the rinsing pump 124 stops, and one cycle of operation of the dishwasher 101 is completed.

In the operation of this dishwasher 101, there is a possibility that while washing dishes sprayed washing water could penetrate into the rinsing water distribution pipe 170 particularly through the rinsing water spray holes of the lower rinsing nozzle 115, and in the worst case washing water with detergent or dirt could flow back into the rinsing water tank 122. However, as shown in FIG. 10, in the dishwasher 101 the structure of the upstream side rinsing water distribution pipe 171 between the washing pump 119 and the rinsing pump 124 has a loop shaped trap, so reverse flow of washing water containing detergent or dirt into the rinsing water tank 122 can be prevented.

Next, the washing pump 119, the washing water distribution pipe 160, and the rinsing water distribution pipe 170 are explained in more detail.

Figure 12:
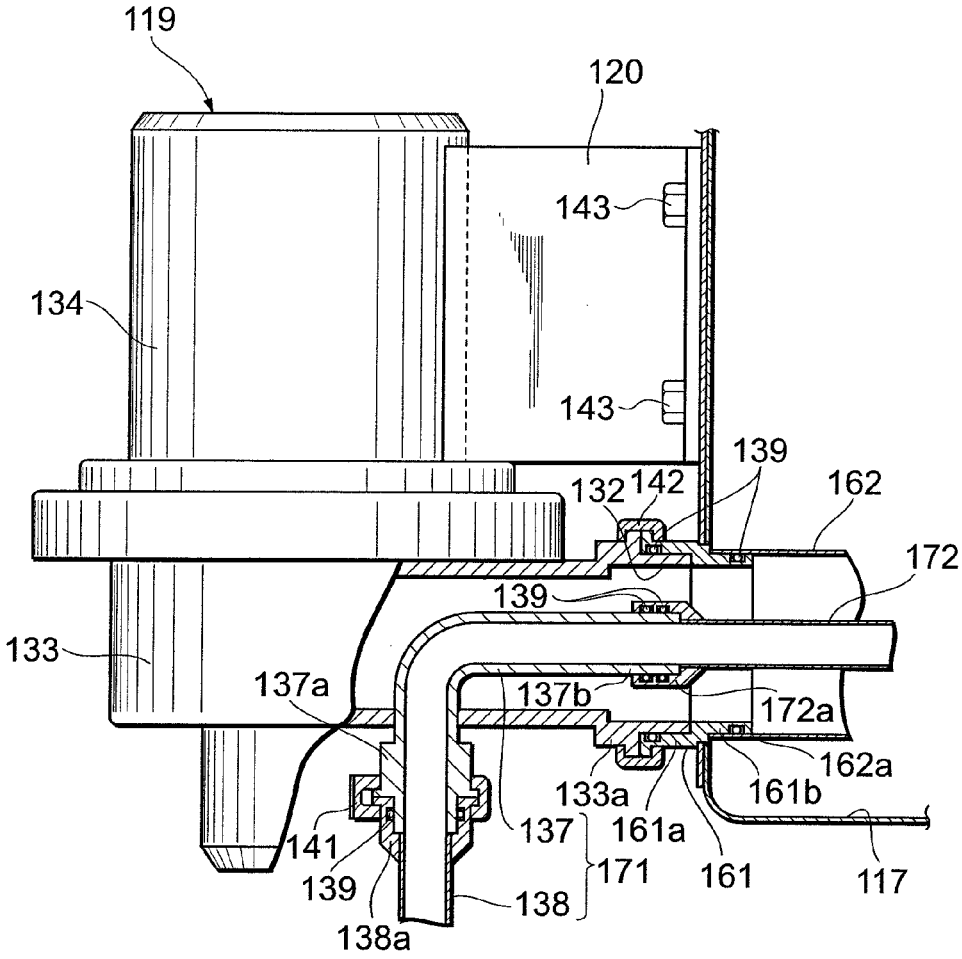
FIG. 12 is an enlarged view of part of the dishwasher of FIG. 11.
Figure 13:
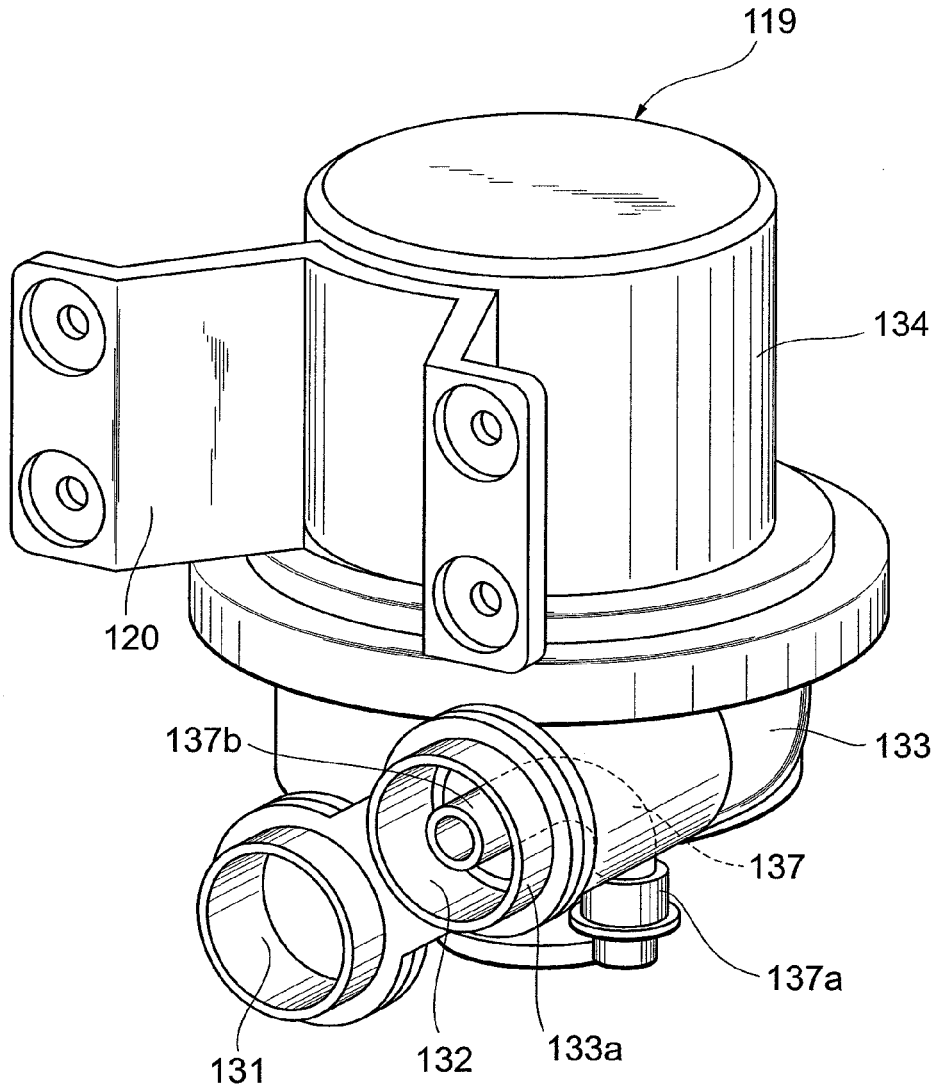
FIG. 13 is an isometric view of the washing pump.

As shown in FIGS. 12 and 13, the washing pump 119 has a pipe 137 that extends into the casing 133 from the washing water outlet 132 and penetrates the wall of the casing 133 in a downward direction. It is desirable that the casing 133 and the pipe 137 are formed integrally from resin. This is because manufacture of the casing 133 including the pipe 137 can be simplified, and water leakage can be prevented. An end portion 138*a* of a pipe 138 connected to the rinsing water outlet 136 of the rinsing water pump 124 is fitted to an end portion 137*a* of the pipe 137 via an O-ring 139, and as a result the pipe 137 and the pipe 138 are connected, to form the upstream side rinsing water distribution pipe 171. Also, an end portion 161*a* of the upstream side washing water distribution pipe 161 is fitted to an end portion 133*a* formed in the washing water outlet 132 in the casing 133 of the washing pump 119 via an O-ring 139. The upstream side washing water distribution pipe 161 is made of metal, and is fixed by welding where it penetrates the wall of the metal washing water tank 117. Leakage of water from the connection of the washing water tank 117 and the upstream side washing water distribution pipe 161 can be prevented by welding, and moreover the strength of the connection can be improved.

A connector 141 that can be freely attached and removed is fitted to the flanges formed on each end portion 137*a*, 138*a*, and a connector 142 that can be freely attached and removed is fitted to the flanges formed on each end portion 133*a*, 161*a*. As a result, if the connector 141 is removed the connection of the end portion 137*a* and the end portion 138*a* is dismantled, and if the connector 142 is removed the connection of the end portion 133*a* and the end portion 161*a* is dismantled, and if bolts 143 connecting the bracket 120 to the wall of the washing water tank 117 are removed, the washing pump 119 can be removed. In this way the washing pump 119 can be easily removed, so the maintainability of the washing pump 119 can be improved.

Figure 14:
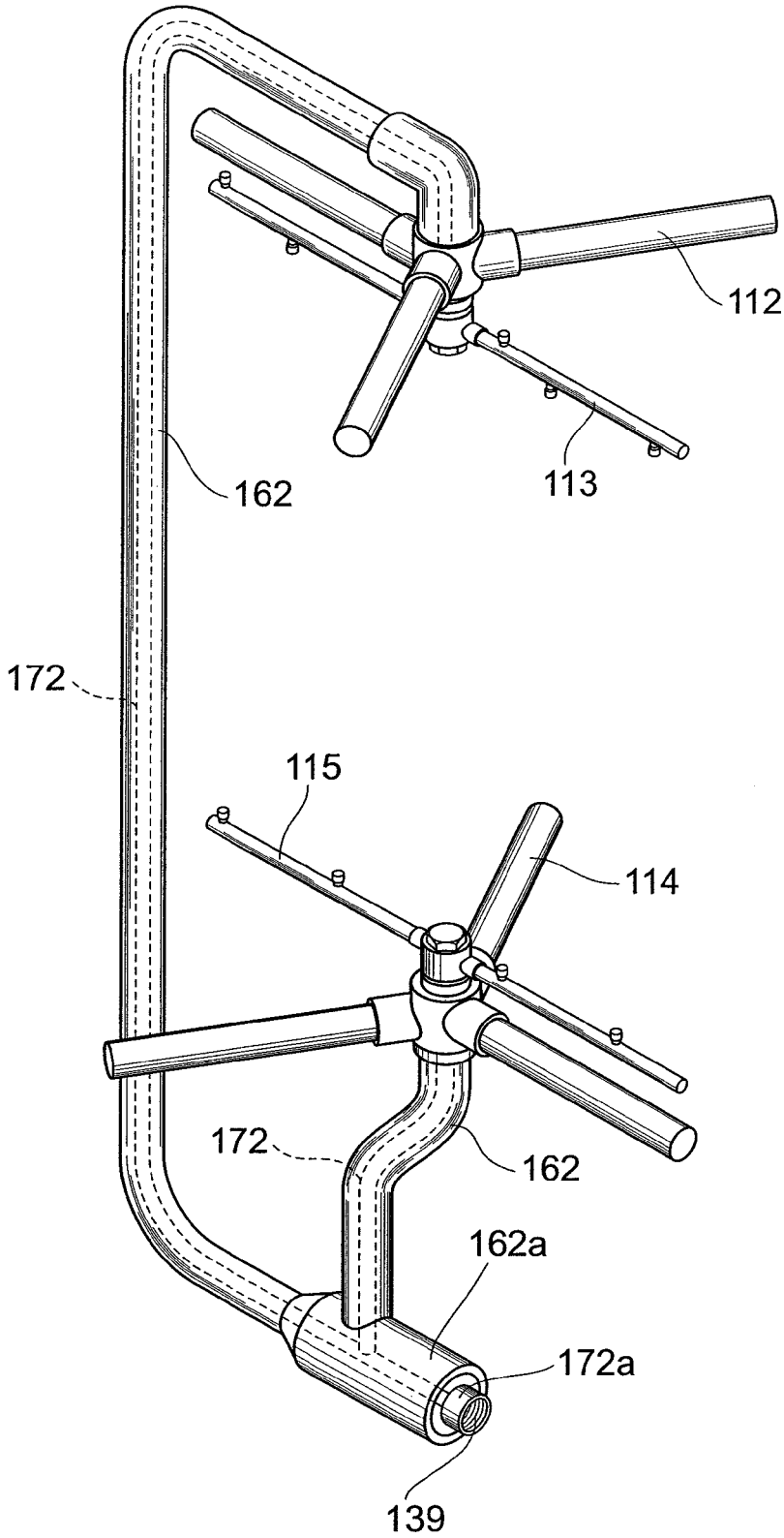
FIG. 14 is an isometric view of the double-structure distribution pipes.

Also, as shown in FIGS. 12 and 14, in the upstream side washing water distribution pipe 161 an end portion 161*b* projecting into the washing water tank 117 is fitted to an end portion 162*a* of the downstream side washing water distribution pipe 162 via an O-ring 139, and an end portion 137*b* of the pipe 137 of the upstream side rinsing water distribution pipe 171 is fitted to an end portion 172*a* of the downstream side rinsing water distribution pipe 172 via an O-ring 139. Here, the downstream side washing water distribution pipe 162 and the downstream side rinsing water distribution pipe 172 are integrated as a double structure distribution pipe, as shown in FIG. 14, so the connection of the upstream side washing water distribution pipe 161 and the downstream side washing water distribution pipe 162 and the connection of the upstream side rinsing water distribution pipe 171 and the downstream side rinsing water distribution pipe 172 can be made from within the washing chamber 103, by inserting the end portions 162*a*, 172*a* into the washing water tank 117 from the washing chamber 103 and fastening them to the end portions 161*b*, 137*b*. Also, dismantling the connection of the upstream side washing water distribution pipe 161 and the downstream side washing water distribution pipe 162, and dismantling the connection of the upstream side rinsing water distribution pipe 171 and the downstream side rinsing water distribution pipe 172 can also of course be carried out from within the washing chamber 103. Also, the downstream side washing water distribution pipe 162 and the downstream side rinsing water distribution pipe 172 integrated as a double structure distribution pipe may be fixed to the rear surface of the washing chamber 103 by a bracket (not shown in the drawings) so that it can be freely attached and removed. In this way, it is possible to stably fix the downstream side washing water distribution pipe 162 and the downstream side rinsing water distribution pipe 172 within the washing chamber 103.

In the dishwasher 101 configured as described above, the rinsing water distribution pipe 170 that connects the rinsing pump 124 and the rinsing nozzles 113, 115 is arranged within the washing water distribution pipe 160 that connects the rinsing pump 119 and the rinsing nozzles 112, 114, moreover, the rinsing water distribution pipe 170 penetrates the casing 133 of the washing pump 119 via the washing water outlet 132. In this way, the piping from the washing pump 119 to the nozzles 112~115 is a double structure distribution pipe formed from the washing water distribution pipe 160 and the rinsing water distribution pipe 170, so it is possible to simplify the layout of the washing water distribution pipe 160 and the rinsing water distribution pipe 170. Therefore, the space within the washing chamber 103 increases, and piping cost is reduced, and benefits are obtained from the hygiene, cleaning, and maintenance aspects. Furthermore, for piping a double structure distribution pipe consisting of the washing water distribution pipe 160 and the rinsing water distribution pipe 170, one fewer insertion hole is required in the washing water tank 117 compared with the case of separately piping the washing water distribution pipe 160 and the rinsing water distribution pipe 170.

Also, the connection of the upstream side washing water distribution pipe 161 and the downstream side washing water distribution pipe 162, and the connection of the upstream side rinsing water distribution pipe 171 and the downstream side rinsing water distribution pipe 172 can be freely attached and detached from within the washing chamber 103, so the downstream side washing water distribution pipe 162 and the downstream side rinsing water distribution pipe 172 can be easily attached and detached from the washing chamber 103 side. Moreover, the downstream side washing water distribution pipe 162 and the downstream side rinsing water distribution pipe 172 are integrated as a double structure distribution pipe, so the downstream side washing water distribution pipe 162 and the downstream side rinsing water distribution pipe 172 can be handled extremely easily. Therefore the operability and maintainability of the downstream side washing water distribution pipe 162 and the downstream side rinsing water distribution pipe 172 can be improved.

The second invention is not limited to the embodiment described above. For example, in the embodiment described above, the washing pump 119 was arranged vertically, but in the second invention the washing pump 119 may be arranged horizontally. Also, the washing pump 119 is not limited to the side surface of the washing water tank 117, for example, it may be arranged on the bottom of the mechanical chamber 104 by extending the upstream side washing water distribution pipe 161. In this case, the upstream side washing water distribution pipe 161 may be configured as a plurality of pipes connected together, such as a pipe fixed by welding to the washing water tank 117 and another pipe. Also, the end portion 137*a* of the pipe 137 is not limited to the underside of the casing 133, for example the end portion 137*a* may be arranged to the side of the casing 133 or to another part. Furthermore, the upstream side washing water distribution pipe 161 is separate from the casing 133 from considerations of maintenance, but the casing 133 and the upstream side washing water distribution pipe 161 may be made integrally from metal, and directly installed in the washing water tank 117 by welding or similar. In this case, the part that projects into the washing water tank 117 becomes the upstream side washing water distribution pipe 161.

INDUSTRIAL APPLICABILITY

According to the first invention, the washing water distribution pipe on which the washing nozzles are installed and the rinsing water distribution pipe on which the rinsing nozzles are installed can be easily inserted and removed from the washing chamber side.

Also, according to the second invention, the layout of the washing water distribution pipe and the rinsing water distribution pipe can be simplified.

The invention claimed is:

1. A dishwasher in which dishes are housing a washing chamber, and washing water is sprayed from washing nozzles to clean the dishes, and rinsing water is sprayed from rinsing nozzles to rinse the dishes in the washing chamber, comprising:

a washing water distribution pipe arranged within the washing chamber and on which the washing nozzles are installed; and a rinsing water distribution pipe arranged within the washing chamber and on which the rinsing nozzles are installed and which can be installed integrally with the washing water distribution pipe, wherein an upstream end of the washing water distribution pipe is removably attached to a first connecting pipe connected to an outlet side of a washing water supply pump in a washing water tank in the bottom of the washing chamber such that the first connecting pipe extends toward the opposite side of the front surface of the washing water tank, wherein the rinsing water distribution pipe is removably attached to a second connecting pipe connected to the outlet side of a rinsing water supply pump in the washing water tank; wherein the washing water supply pump is installed in a front surface of the washing water tank so that an inlet and an outlet of the washing water supply pump are positioned within the washing water tank, wherein the washing water distribution pipe comprises a main line portion from the upstream end passing through a rear of the washing chamber to a top portion of an interior of the washing chamber, and an upper upstand pointing directly downwards in a center of the top portion, and the washing water distribution pipe further comprises a lower upstand directly below the upper upstand branching from the main line portion and pointing directly upwards, wherein the main line portion of the washing water distribution pipe is fixed to the rear surface of the washing chamber by a bracket, and wherein the rinsing water distribution pipe is arranged within the washing water distribution pipe, and the second connecting pipe is arranged within the first connecting pipe.

2. The dishwasher according to claim 1, wherein the first connecting pipe is provided on a casing that houses an impeller of the washing water supply pump, and the second connecting pipe extends from within the first connecting pipe through the casing to the outside and is connected to the outlet side of the rinsing water supply pump.

3. The dishwasher according to claim 1, wherein a removably attached casing that houses an impeller of the washing water supply pump is arranged within the washing water tank, and the washing water distribution pipe is connected to the first connecting pipe provided on the casing.

* * * * *